US008402697B1

(12) United States Patent
Ealer, Sr.

(10) Patent No.: US 8,402,697 B1
(45) Date of Patent: Mar. 26, 2013

(54) GUTTER COVER WITH REAR COMPOUND BEND

(71) Applicant: James E. Ealer, Sr., St. Clair, MO (US)

(72) Inventor: James E. Ealer, Sr., St. Clair, MO (US)

( * ) Notice: Subject to any disclaimer, the term of this patent is extended or adjusted under 35 U.S.C. 154(b) by 0 days.

(21) Appl. No.: 13/645,677

(22) Filed: Oct. 5, 2012

(51) Int. Cl.
*E04D 13/00* (2006.01)

(52) U.S. Cl. ..... 52/12; 52/15

(58) Field of Classification Search ..... 52/11, 12, 52/15; D23/261, 267
See application file for complete search history.

(56) References Cited

U.S. PATENT DOCUMENTS

| | | | | |
|---|---|---|---|---|
| 891,406 | A | 6/1908 | Cassens et al. | |
| 1,597,503 | A | 8/1926 | Andrews | |
| 2,175,521 | A | 10/1939 | Fry | |
| 2,209,741 | A | 7/1940 | Sullivan et al. | |
| 2,271,081 | A | 1/1942 | Layton | |
| 2,988,226 | A | 6/1961 | Campbell | |
| 3,067,881 | A | 12/1962 | Goosmann | |
| 3,351,206 | A | 11/1967 | Wennerstrom | |
| 3,388,555 | A | 6/1968 | Foster | |
| 3,950,951 | A | 4/1976 | Zukauskas | |
| 4,307,976 | A | 12/1981 | Butler | |
| 4,418,504 | A | 12/1983 | Lassiter | |
| 4,631,875 | A | 12/1986 | Olson | |
| 4,727,689 | A * | 3/1988 | Bosler | 52/12 |
| 4,750,300 | A | 6/1988 | Winger, Jr. | |
| 4,769,957 | A | 9/1988 | Knowles | |
| 4,796,390 | A | 1/1989 | Demartini | |
| 4,905,427 | A | 3/1990 | McPhalen | |
| 4,907,381 | A * | 3/1990 | Ealer | 52/12 |
| 4,936,061 | A | 6/1990 | Palma | |
| 4,937,986 | A | 7/1990 | Way, Sr. et al. | |
| 4,941,299 | A | 7/1990 | Sweers | |
| 5,072,551 | A | 12/1991 | Manoogian, Jr. | |
| 5,092,086 | A | 3/1992 | Rognsvoog, Sr. | |
| 5,109,640 | A | 5/1992 | Creson | |
| 5,251,410 | A | 10/1993 | Carey | |
| 5,271,191 | A | 12/1993 | Vahamaki | |
| 5,271,192 | A | 12/1993 | Nothum, Sr. et al. | |
| 5,438,803 | A | 8/1995 | Blizard, Jr. | |
| 5,619,825 | A * | 4/1997 | Leroney et al. | 52/12 |
| 5,709,051 | A | 1/1998 | Mazziotti | |
| 5,813,173 | A | 9/1998 | Way, Sr. | |
| 5,842,311 | A | 12/1998 | Morin | |
| 5,893,240 | A | 4/1999 | Ealer, Sr. | |
| 6,151,836 | A | 11/2000 | McGlothlin et al. | |
| 6,151,837 | A | 11/2000 | Ealer, Sr. | |
| 6,412,228 | B1 * | 7/2002 | Meckstroth | 52/12 |
| 6,568,132 | B1 | 5/2003 | Walters | |
| 6,598,352 | B2 | 7/2003 | Higginbotham | |
| 6,883,760 | B2 | 4/2005 | Seise, Jr. | |
| D523,538 | S | 6/2006 | Brochu | |
| 7,627,991 | B1 | 12/2009 | Feldhaus | |

(Continued)

OTHER PUBLICATIONS

Office action dated Jun. 17, 2009 for U.S. Appl. No. 11/567,919, 17 pages.

(Continued)

*Primary Examiner* — Joshua J Michener
*Assistant Examiner* — Chi Q Nguyen
(74) *Attorney, Agent, or Firm* — Senniger Powers LLP

(57) ABSTRACT

A gutter protection system is disclosed. The system includes a gutter cover having, as viewed in cross-section when the gutter cover is installed, a front section configured for engagement with the rearward-projecting flange of the gutter, a center section covering the gutter, and a rear section configured for engagement with the hanger. The rear section has a novel compound bend configuration.

17 Claims, 3 Drawing Sheets

U.S. PATENT DOCUMENTS

| | | | | |
|---|---|---|---|---|
| 7,650,720 | B2 * | 1/2010 | Ealer, Sr. | 52/12 |
| 7,891,142 | B1 * | 2/2011 | Ealer, Sr. | 52/12 |
| 2006/0101722 | A1 | 5/2006 | Ealer, Sr. | |
| 2006/0201068 | A1 | 9/2006 | Shane | |
| 2006/0230687 | A1 | 10/2006 | Ealer, Sr. | |
| 2008/0134587 | A1 | 6/2008 | Ealer | |

OTHER PUBLICATIONS

Office action dated Jun. 14, 2010 for U.S. Appl. No. 11/567,919, 11 pages.

* cited by examiner

GUTTER COVER WITH REAR COMPOUND BEND

FIELD OF THE INVENTION

The present invention generally relates to generally to rain gutters and more particularly to a gutter protection system or cover for preventing debris from falling into such gutters.

BACKGROUND OF THE INVENTION

Background information regarding existing gutter covers and screens may be found in my U.S. Pat. Nos. 4,907,381, 5,893,240 and 6,151,837, and 7,891,142, incorporated by reference herein for all purposes. Since leaves and other debris frequently clog up rain gutters, some kind of cover which prevents debris from falling into the gutter is desirable. Ideally, a gutter cover directs water into the gutter, prevents debris from entering the gutter, does not itself become clogged with debris, does not collapse into the gutter under loads (such as snow or debris loads), and is securely attached to the gutter. The ideal gutter protection requires no maintenance after installation.

SUMMARY OF THE INVENTION

This invention relates to a gutter protection system for covering a gutter of a structure and for preventing debris from falling into the gutter. The gutter includes a gutter hanger comprising a generally horizontal leg extending from adjacent a rearward-projecting flange on a front wall of the gutter to adjacent a back wall of the gutter and a generally vertical leg extending up from the horizontal leg adjacent the back wall of the gutter, and a fastener securing the generally vertical leg of the hanger and the back wall of the gutter to the structure at the rear of the gutter. The gutter protection system comprises a gutter cover sized and shaped to cover the gutter. The gutter cover comprises, as viewed in cross-section when the gutter cover is installed, a front section configured for engagement with the rearward-projecting flange of the gutter, a center section covering the gutter, and a rear section configured for engagement with the hanger. The rear section comprises a first forward-opening bend, a second forward-opening bend spaced downward from the first bend, a third rearward-opening bend spaced downward from the second bend, a fourth rearward-opening bend spaced downward from the third bend, a first leg extending substantially vertically downward from the first bend to the second bend, a second leg angling downward and forward from the second bend to the third bend to provide clearance for said fastener, a third substantially straight leg extending generally vertically downward from the third bend to form a recess for receiving the fastener, and a fourth leg extending rearward from the fourth bend. The fourth leg has a tail which terminates in a rearward end spaced a substantial distance rearward from the first leg whereby the tail is adapted to engage a corner of the hanger at the intersection of the generally horizontal and generally vertical legs of the hanger in a manner which maintains the gutter cover in an installed position. In this position, the first bend is spaced by a gap forward from the vertical leg of the hanger and the tail of the rear section of the gutter cover is in contact with the gutter hanger generally adjacent the corner of the gutter hanger.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
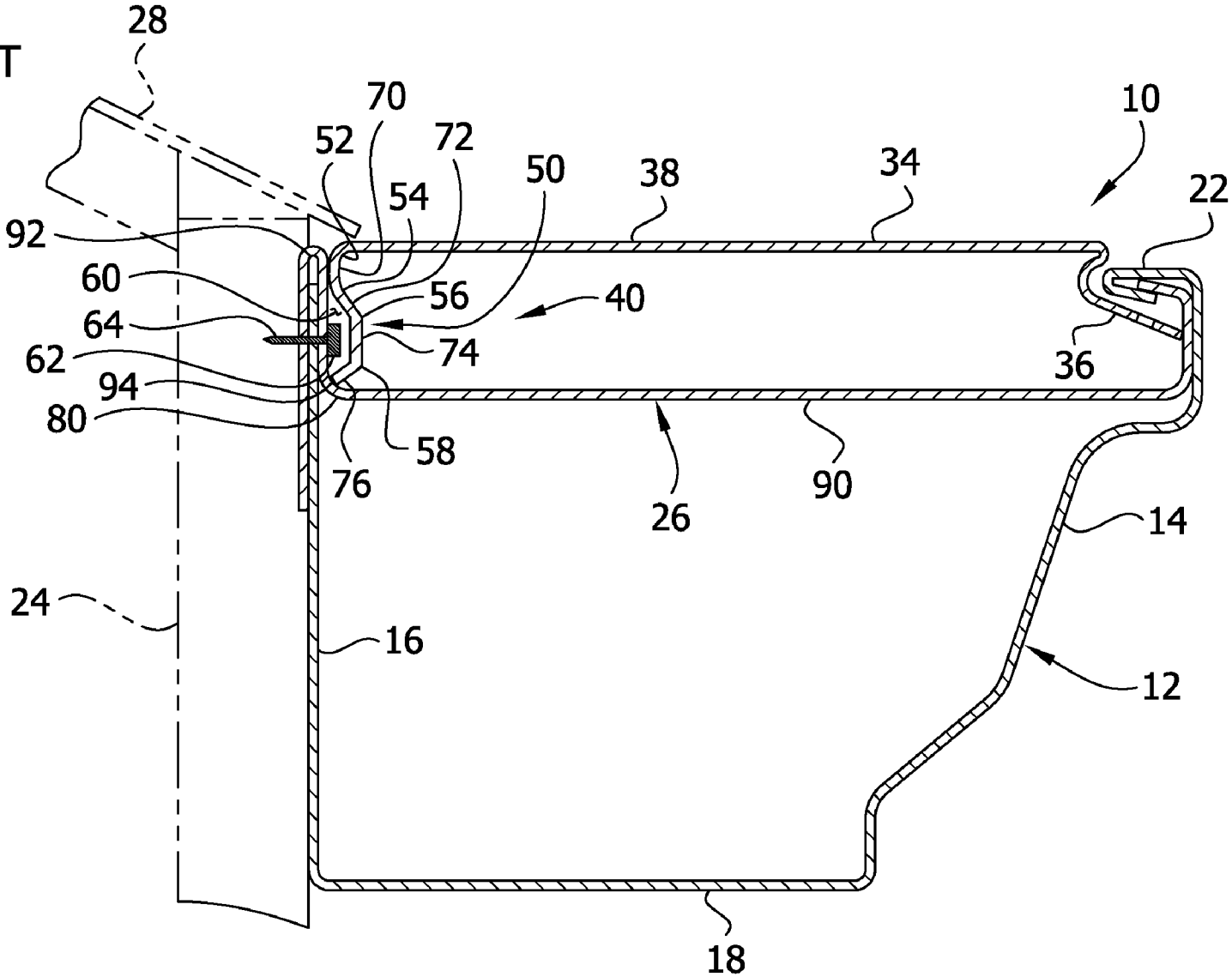
FIG. 1 PRIOR ART
FIG. 1 is a transverse cross-sectional view of a gutter cover of a prior design installed on a gutter.

FIG. 1 illustrates a gutter cover, generally designated 10, having a design described in U.S. Pat. No. 7,891,142 (see FIG. 16 of that patent). The gutter cover 10 is particularly adapted for covering a conventional rain gutter 12 and preventing debris from falling into the gutter. As shown in FIG. 1, the gutter 12 has a front wall 14, a back wall 16 and a bottom wall 18, which combine to form a channel for drainage of rainwater. A conventional flange 22 projects rearward (i.e., toward the building) from the upper edge of the front wall 14. The gutter 12 is suitably attached to a supporting structure such as fascia 24 of the building by gutter hangers 26, only one of which is shown in FIG. 1, extending from the front flange 22 of the gutter to the back wall 16 of the gutter. The gutter 12 collects rainwater flowing off an eave 28 of the building (as formed by shingles, for example) that typically slopes downward and overhangs the fascia 24, as will understood by those skilled in this field. The gutter cover 10 receives water from the roof 28 and directs the water into the gutter 12.

The gutter cover 10 comprises an elongate sheet 34 of resilient material having a longitudinal axis transverse to the direction F1 of water flow down the roof. The sheet 34 includes a front section 36 adjacent the front of the gutter, a center section 38 extending rearward from the front section to cover the gutter, and a rear section 40 adjacent the back of the gutter. The front section 36 is configured to engage the front flange 22 of the gutter, and the rear section is configured to engage the gutter hangers 26, as described in the aforementioned U.S. Pat. No. 7,891,142 (see FIG. 16).

The rear section 40 is formed as a compound bend, generally designated 50, comprising an upper (first) bend 52, an inward (second) bend 54, and two (third and fourth) outward bends 56 and 58. The bends together form a recess 60 for receiving the head 62 of a fastener 64 fastening the gutter hanger 26 to the fascia 24 or surrounding structure. As shown in FIG. 1, the bends 52, 54, 56, 58 are connected by a first upper portion or leg 70 extending generally vertically downward from the first bend to the second bend, a second intermediate portion or leg 72 angling downward and forward from the second bend 54 to the third bend 56, a third substantially straight intermediate portion or leg 74 extending generally vertically downward from the third bend 56 to the fourth bend 58, and a fourth lower portion or leg 76 angling downward and rearward from the fourth bend 58. The recess 60 is formed by legs 72, 74, and 76 connected by bends 56 and 58. The lower leg 76 is generally received in a space between the fastener head 62 and a rearward bend or corner 80 of the hanger 26 at the intersection of a generally horizontal leg 90 of the hanger and a generally vertical leg 92 of the hanger. The lower leg 76 of the rear section 40 terminates at a rearward end 94 that is in generally vertical alignment (i.e., generally co-planar) with the upper bend 52 and is intended to be received in the corner 80 of the gutter hanger 26 to hold the gutter cover 10 in place.

Figure 2:
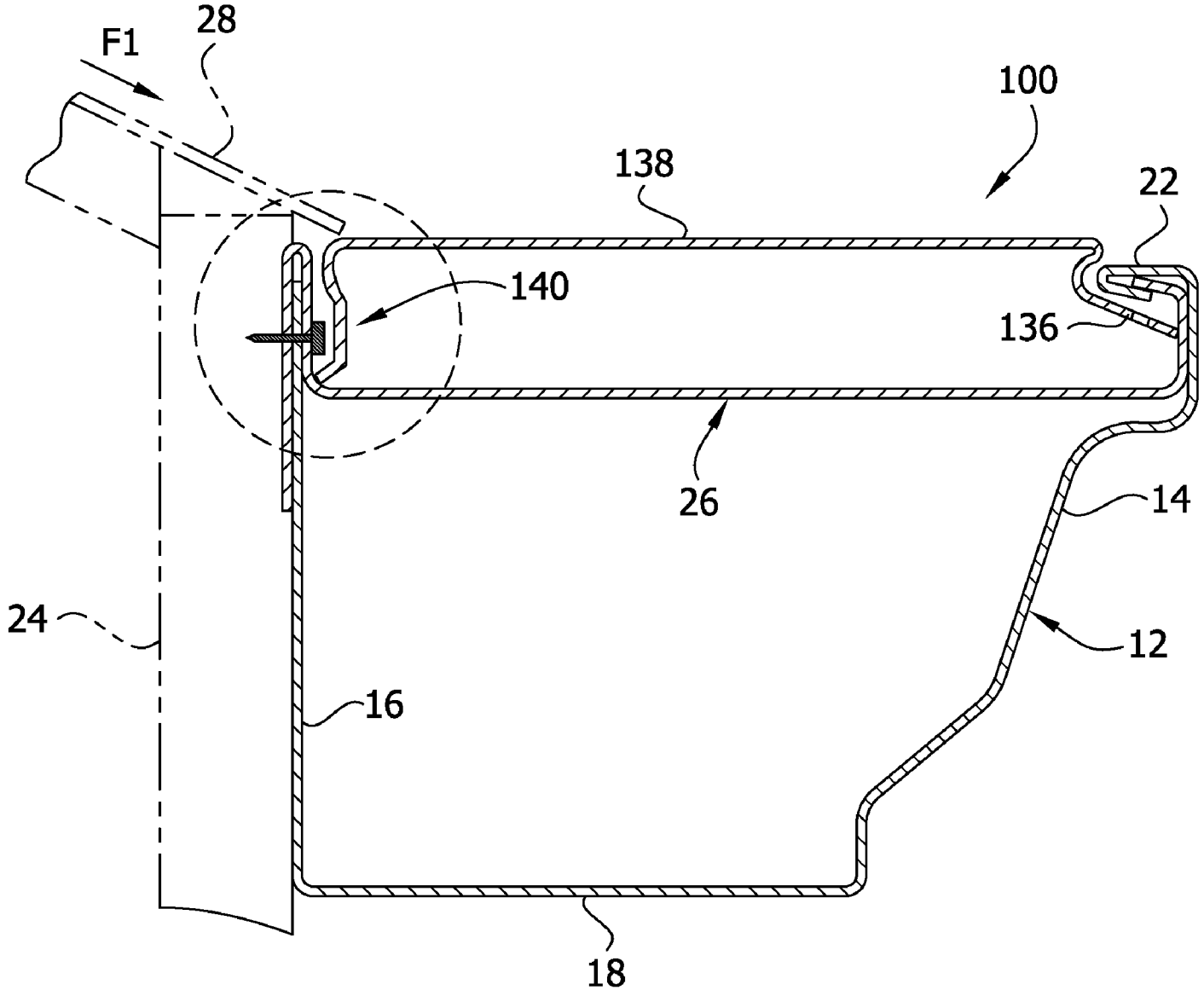
FIG. 2 is a transverse cross-sectional view of a gutter cover of this invention, as installed on a gutter.
Figure 3:
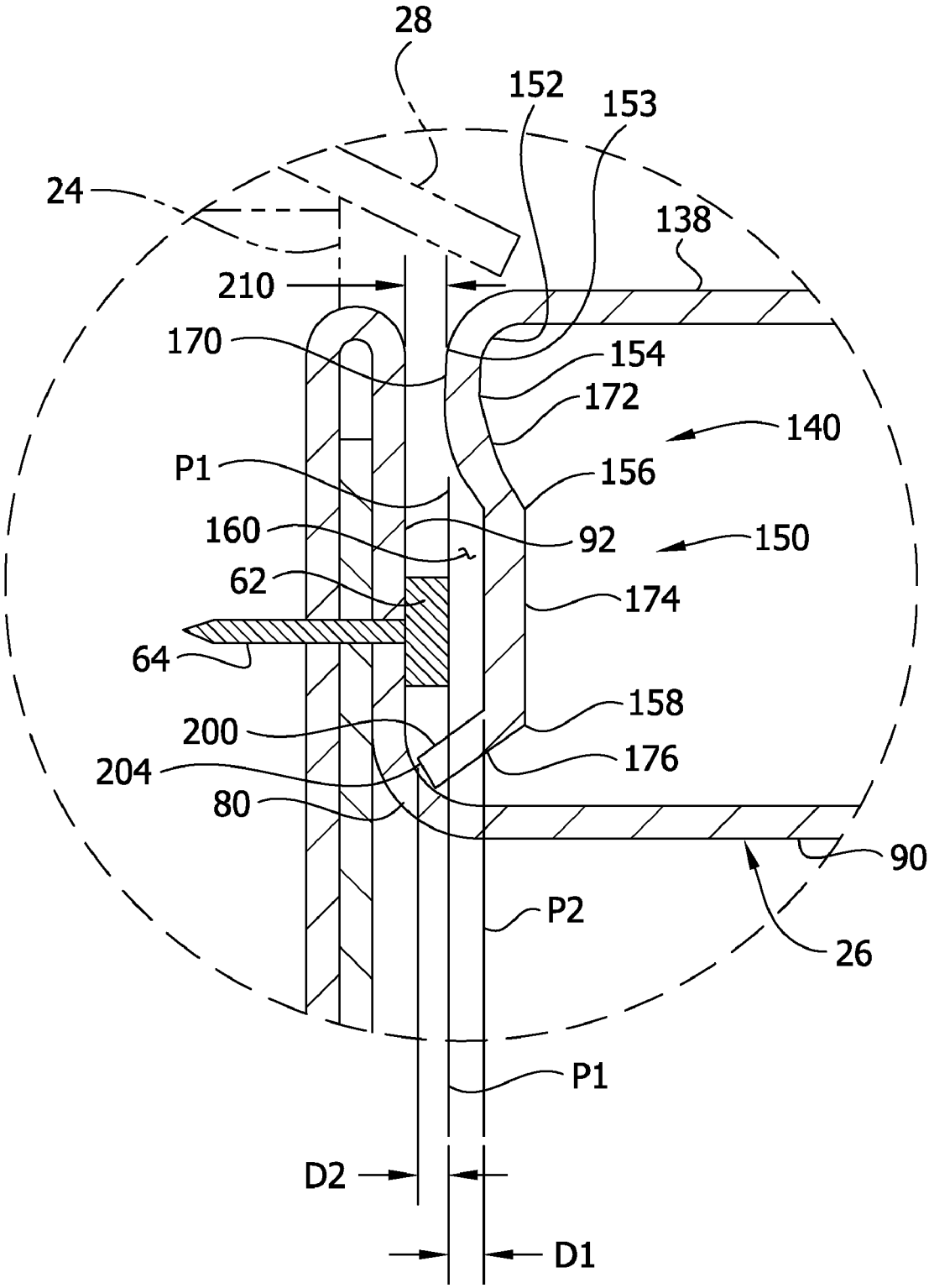
FIG. 3 is an enlarged fragment of FIG. 2 illustrating the rear compound bend of the gutter cover.

FIGS. 2 and 3 illustrate a gutter cover of the present invention, generally designated 100, as installed on the gutter 10 illustrated in FIG. 1. The gutter cover 100 comprises an elongate sheet of resilient material having a longitudinal axis transverse to the direction F1 of water flow down the roof. By way of example but not limitation, the gutter cover may be made of a solid sheet material, or expanded metal, or wire screen. The material may be either metal or plastic.

The gutter cover 100 is similar to cover 10 in that it comprises a front section 136 adjacent the front of the gutter 12, a center section 138 extending rearward from the front section to cover the gutter, and a rear section generally designated 140 adjacent the back of the gutter. The front section 136 is configured to engage the front flange 22 of the gutter, and the rear section 140 is configured to engage the gutter hangers 26. By way of example only, the front section 136 may have a configuration as described in my U.S. Pat. No. 4,907,381. The front section may also have other configurations, such as those described in my U.S. Pat. No. 7,650,720.

As best illustrated in FIG. 3, the rear section 140 of the gutter cover 100 is formed as a compound bend, generally designated 150, comprising an upper (first) bend 152, an inward (second) bend 154, and two (third and fourth) outward bends 156 and 158. The bends together form a recess 160 for receiving the head 62 of the fastener 60 fastening the gutter hanger 26 to the fascia 24 or surrounding structure. As shown in FIG. 3, the bends 152, 154, 156, 158 are connected by a first substantially straight upper portion or leg 170 extending generally vertically downward in a first plane P1 from the first bend 152 to the second bend 154, a second substantially straight intermediate portion or leg 172 angling downward and forward from the second bend 154 to the third bend 156, a third substantially straight intermediate portion or leg 174 extending generally vertically downward in a plane P2 from the third bend 156 to the fourth bend 158, and a fourth substantially straight lower portion or leg 176 angling downward and rearward from the fourth bend 158. The recess 160 is formed by legs 172, 174, and 176 connected by bends 156 and 158. The lower leg 176 is generally received in a space between the fastener head 62 and the corner 80 of the hanger 26. In the illustrated embodiment, plane P2 is spaced a suitable forward distance D1 (e.g., 0.25 in.) forward from the plane P1 of the upper leg 170.

The lower leg 176 of the rear section 140 of the gutter cover 100 has an extension or tail 200 (not present in the design of FIG. 1) which terminates in a rearward end 204 spaced a substantial rearward distance D2 rearward from a juncture 153 between the upper bend 152 and the plane P1 of the upper leg 170. By way of example, this distance D2 may be in the range of 0.0625-0.50 inch or more. In one embodiment, D2 is greater than D1, but D2 can be equal to or less than D1. The additional length provided by the tail 200 insures that the lower leg 176 will engage the gutter hanger at the corner 80 to maintain the gutter cover in a properly installed position in which the juncture 153 between the upper bend 152 and the upper leg 170 is spaced by a gap 210 forward from the vertical leg 90 of the gutter hanger 26 and in which the gutter cover is held resiliently flexed in a tensioned configuration. In this tensioned configuration, the gutter cover 100 extends over the gutter with the front section 136 of the gutter cover 100 in pressure contact with the flange 22 of the gutter and/or the front portion of the hanger 26, with the tail 200 of the rear section in pressure engagement with the gutter hanger 26 generally adjacent the corner 80 of the hanger, and with the center section 138 of the gutter cover resiliently arched from its otherwise substantially flat condition (when uninstalled). As a result, the gutter cover 100 is held securely attached to the gutter 22, as shown in FIG. 2. (The amount of arch in the gutter cover illustrated in FIG. 2 is very small and thus not apparent. The amount of arch may be larger.) Moreover, the rear section 140 of the gutter cover 100 is held against unintentional upward lift away from the horizontal leg 90 of the gutter hanger 26 by engagement of the tail 200 with the head 62 of the fastener 60. As a result, the gutter cover 100 is maintained in the correct vertical and horizontal position relative to the gutter 22 and the gutter hanger 26. In this regard, it is desirable that the gap 210 between the juncture 153 of the upper bend 152 and upper leg 170 of the gutter cover and the vertical leg 92 of the gutter hanger 26 be greater than 0.00 in and desirably at least 0.0625-0.50 in. Absent such a gap, the gutter cover will not stay properly engaged below the fastener 64, and there is a risk the gutter cover will raise up from its properly installed position.

In view of the foregoing, it will be observed that the configuration of the rear section 136 of the gutter 100 provides important advantages. The configuration provides both the recess 160 which receives the head of the fastener attaching the gutter and hanger to the fascia 24 and the relatively long tail 200 which holds the gutter in its resiliently flexed arched configuration securely attached to the gutter. Without the tail 200 extending a distance (D2) rearward from the plane P1 of the upper leg, the upper bend 152 of the rear section 140 would have a tendency to contact the vertical leg 92 of the hanger 26 before the lower leg 176 engaged the rear bend of the hanger 26 at the corner 80, thus preventing the proper installation of the gutter cover. The tail insures that the lower leg 176 will engage the rear bend of the hanger 26 (or the vertical leg 92 of the hanger) before the upper bend 152 and/or upper leg 170 of the gutter cover engages the vertical leg 92 of the hanger 26, so that the gutter cover can be properly installed in the position described above in which it is maintained in a resiliently flexed configuration arching over the gutter.

In other embodiments, the gutter cover is held in its installed position on the gutter 12 without being resiliently flexed over the gutter. By way of example, the gutter cover may have a configuration essentially identical to the gutter cover shown in FIGS. 2 and 3, except that the cover is dimensioned such that it is not in a resiliently flexed condition after it has been installed (e.g., the gutter cover may be resiliently flexed during the installation process, after which it assumes a non-flexed configuration.) If the gutter cover is not resiliently flexed after installation, one or more fasteners may be used to secure the front section of the gutter cover to the gutter flange 22 (or to a gutter hanger 26) in a position in which the tail (e.g., 200) of the rear section of the gutter cover is in contact with the gutter hanger 26 adjacent the corner 80 of the hanger (e.g., as shown in FIG. 3) to prevent unintentional lift of the rear section of the gutter cover away from its installed position.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A gutter protection system for covering a gutter of a structure and for preventing debris from falling into the gutter, the gutter including a gutter hanger comprising a generally horizontal leg extending from adjacent a rearward-projecting flange on a front wall of the gutter to adjacent a back wall of the gutter and a generally vertical leg extending up from the horizontal leg adjacent the back wall of the gutter, and a fastener securing the generally vertical leg of the hanger and the back wall of the gutter to supporting structure at the rear of the gutter, the gutter protection system comprising a resilient gutter cover sized and shaped to cover the gutter, the gutter cover including, as viewed in cross-section when the gutter cover is installed on the gutter:

a front section configured for engagement with the rearward-projecting flange of the gutter;

a center section covering the gutter; and a rear section configured for engagement with the hanger;

the rear section comprising a first forward-opening bend, a second forward-opening bend spaced downward from the first bend, a third rearward-opening bend spaced downward from the second bend, a fourth rearward-opening bend spaced downward from the third bend, a first leg extending from a juncture with the first bend downward to the second bend, a second leg angling downward and forward from the second bend to the third bend to provide clearance for said fastener, a third substantially straight leg extending generally vertically downward from the third bend to form a recess for receiving the fastener, and a fourth leg extending rearward from the fourth bend;

the fourth leg having a tail which terminates in a rearward end spaced a substantial rearward distance from said juncture whereby the tail is adapted to engage a corner of the hanger at the intersection of the generally horizontal and generally vertical legs of the hanger in a manner which maintains the gutter cover in an installed position in which said juncture is spaced by a gap forward from the vertical leg of the hanger and in which the tail of the rear section of the gutter cover is in contact with the gutter hanger generally adjacent the corner of the gutter hanger.

2. The gutter protection system of claim 1, wherein said substantial rearward distance is in the range of 0.0625-0.50 inch.

3. The gutter protection system of claim 1, wherein the first leg lies in a first generally vertical plane, and wherein said substantial rearward distance is in the range of 0.0625-0.50 inch from said first generally vertical plane.

4. The gutter protection system of claim 1, wherein said third leg lies in a second generally vertical plane spaced a forward distance from the first generally vertical plane, and wherein said substantial rearward distance is greater than said forward distance.

5. The gutter protection system of claim 1, wherein the fourth leg extends downward and rearward from the fourth bend.

6. The gutter protection system of claim 5, wherein the fourth leg, including the tail, is substantially straight.

7. The gutter protection system of claim 1, wherein the gutter cover is held in said installed position resiliently flexed over the gutter.

8. The gutter protection system of claim 1, wherein the gutter cover is held in said installed position without being resiliently flexed over the gutter.

9. A gutter protection system for covering a gutter of a structure and for preventing debris from falling into the gutter, the gutter including a gutter hanger comprising a generally horizontal leg extending from adjacent a rearward-projecting flange on a front wall of the gutter to adjacent a back wall of the gutter and a generally vertical leg extending up from the horizontal leg adjacent the back wall of the gutter, and a fastener securing the generally vertical leg of the hanger and the back wall of the gutter to supporting structure at the rear of the gutter, the gutter protection system comprising a resilient gutter cover sized and shaped to cover the gutter, the gutter cover including, as viewed in cross-section when the gutter cover is installed on the gutter:

a front section configured for engagement with the rearward-projecting flange of the gutter;

a center section covering the gutter; and a rear section configured for engagement with the hanger;

the rear section comprising a first forward-opening bend, a second forward-opening bend spaced downward from the first bend, a third rearward-opening bend spaced downward from the second bend, a fourth rearward-opening bend spaced downward from the third bend, a first leg extending generally vertically downward from the first bend to the second bend, a second leg angling downward and forward from the second bend to the third bend to provide clearance for said fastener, a third substantially straight leg extending generally vertically downward from the third bend to form a recess for receiving the fastener, and a fourth leg extending rearward from the fourth bend;

the fourth leg having a tail which terminates in a rearward end spaced a substantial rearward distance from the generally vertical first leg whereby the tail is adapted to engage a corner of the hanger at the intersection of the generally horizontal leg and generally vertical leg of the hanger in a manner which maintains the gutter cover in an installed position in which the generally vertical first leg of the rear section of the gutter cover is spaced by a gap forward from the vertical leg of the hanger and in which the tail of the rear section of the gutter cover is in contact with the gutter hanger generally adjacent the corner of the gutter hanger.

10. The gutter protection system of claim 9, wherein said substantial rearward distance is in the range of 0.0625-0.50 inch.

11. The gutter protection system of claim 9, wherein the first leg lies in a first generally vertical plane, and wherein said substantial rearward distance is in the range of 0.0625-0.50 inch from said first generally vertical plane.

12. The gutter protection system of claim 9, wherein the gutter cover is held in said installed position resiliently flexed over the gutter.

13. The gutter protection system of claim 9, wherein the gutter cover is held in said installed position without being resiliently flexed over the gutter.

14. A gutter protection system for covering a gutter of a structure and for preventing debris from falling into the gutter, the gutter including a gutter hanger comprising a generally horizontal leg extending from adjacent a rearward-projecting flange on a front wall of the gutter to adjacent a back wall of the gutter and a generally vertical leg extending up from the horizontal leg adjacent the back wall of the gutter, and a fastener securing the generally vertical leg of the hanger and the back wall of the gutter to supporting structure at the rear of the gutter, the gutter protection system comprising a resilient gutter cover sized and shaped to cover the gutter, the gutter cover including, as viewed in cross-section when the gutter cover is installed on the gutter:

a front section configured for engagement with the rearward-projecting flange of the gutter;

a center section covering the gutter; and a rear section configured for engagement with the hanger;

the rear section comprising a first forward-opening bend, a second forward-opening bend spaced downward from the first bend, a third rearward-opening bend spaced downward from the second bend, a fourth rearward-opening bend spaced downward from the third bend, a first leg extending downward from the first bend to the second bend, a second leg angling downward and forward from the second bend to the third bend to provide clearance for said fastener, a third substantially straight leg extending downward from the third bend to form a recess for receiving the fastener, and a fourth leg extending rearward from the fourth bend;

the fourth leg having a tail which terminates in a rearward end spaced substantially rearward from the first bend and from the first leg whereby the tail is adapted to engage a corner of the hanger at the intersection of the generally horizontal leg and generally vertical leg of the hanger in a manner which maintains the gutter cover in an installed position in which the first bend and first leg of the rear section of the gutter cover are spaced by a gap forward from the vertical leg of the hanger and in which the tail of the rear section of the gutter cover is in contact with the gutter hanger generally adjacent the corner of the gutter hanger.

15. The gutter protection system of claim 14, wherein the rearward end of said tail is spaced a rearward distance in the range of 0.0625-0.50 inch from a juncture of the first leg with the first bend.

16. The gutter protection system of claim 14, wherein the gutter cover is held in said installed position resiliently flexed over the gutter.

17. The gutter protection system of claim 14, wherein the gutter cover is held in said installed position without being resiliently flexed over the gutter.

* * * * *